US011549527B2

(12) United States Patent
Gückel et al.

(10) Patent No.: US 11,549,527 B2
(45) Date of Patent: Jan. 10, 2023

(54) FLUID-ACTUATED LINEAR DRIVE

(71) Applicant: Festo SE & Co. KG, Esslingen (DE)

(72) Inventors: Jürgen Gückel, Filderstadt (DE); Simone Kopp, Esslingen (DE); Ulrich Diener, Esslingen (DE)

(73) Assignee: Festo SE & Co. KG, Esslingen (DE)

( * ) Notice: Subject to any disclaimer, the term of this patent is extended or adjusted under 35 U.S.C. 154(b) by 0 days.

(21) Appl. No.: 17/395,957

(22) Filed: Aug. 6, 2021

(65) Prior Publication Data

US 2022/0049728 A1 Feb. 17, 2022

(30) Foreign Application Priority Data

Aug. 14, 2020 (DE) ..... 102020210344.5

(51) Int. Cl.

| | |
|---|---|
| ***F15B 15/14*** | (2006.01) |
| ***F15B 15/24*** | (2006.01) |
| ***F15B 21/00*** | (2006.01) |
| *F15B 15/22* | (2006.01) |

(52) U.S. Cl.

CPC ..... *F15B 15/1471* (2013.01); *F15B 15/149* (2013.01); *F15B 15/24* (2013.01); *F15B 21/003* (2013.01); *F15B 15/1447* (2013.01); *F15B 15/22* (2013.01); *F15B 2215/30* (2013.01)

(58) Field of Classification Search

CPC .. F15B 15/24; F15B 15/1471; F15B 15/1404; F15B 15/14; F15B 15/228

See application file for complete search history.

(56) References Cited

U.S. PATENT DOCUMENTS

| | | | | |
|---|---|---|---|---|
| 5,884,549 | A * | 3/1999 | Hosono | B23Q 5/26 92/5 R |
| 6,014,924 | A * | 1/2000 | Stoll | B23Q 1/58 92/13 |
| 6,400,047 | B1 * | 6/2002 | Hartramph | F15B 15/14 310/12.33 |
| 7,191,695 | B2 * | 3/2007 | Sato | F15B 15/228 92/13.7 |
| 7,225,722 | B2 * | 6/2007 | Angue | F15B 15/1414 92/165 R |

(Continued)

FOREIGN PATENT DOCUMENTS

| | | | |
|---|---|---|---|
| DE | 102010056367 | A1 | 7/2011 |
| DE | 102012011383 | A1 | 12/2013 |

(Continued)

*Primary Examiner* — Dustin T Nguyen

(74) *Attorney, Agent, or Firm* — Hoffmann & Baron, LLP

(57) ABSTRACT

A fluid actuated linear drive includes a drive housing and a drive member which is movable between two stroke end positions. The drive member has a drive unit with a drive piston which divides off two drive chambers from one another, the drive chambers via two housing channels being connected to axial housing coupling openings which are arranged on a housing rear side. A multi-function module is built onto the housing rear side in a position of use and includes components of an external end position setting device for the drive member and is furthermore provided with module block channel systems which communicate with the housing channels and can be used for the feed and discharge of a drive fluid when the multifunction module is built onto the drive housing in the position of use.

17 Claims, 4 Drawing Sheets

(56) References Cited

U.S. PATENT DOCUMENTS

| | | | | |
|---|---|---|---|---|
| 8,256,961 | B2 * | 9/2012 | Maffeis | F16C 29/12 384/49 |
| 8,998,491 | B2 * | 4/2015 | Ishibashi | F16C 29/0607 384/45 |
| 10,865,816 | B2 * | 12/2020 | Kopp | F15B 15/22 |
| 2008/0127817 | A1 * | 6/2008 | Someya | F15B 15/082 92/163 |

FOREIGN PATENT DOCUMENTS

| | | | |
|---|---|---|---|
| EP | 0868965 | A2 | 10/1998 |
| EP | 1574283 | A1 | 9/2005 |

* cited by examiner

FLUID-ACTUATED LINEAR DRIVE

BACKGROUND OF THE INVENTION

The invention relates to a fluid-actuated linear drive comprising a drive housing and a drive member which by way of fluid force can be driven relative to the drive housing into a linear stroke movement in a housing longitudinal direction, wherein the drive member comprises a drive unit which comprises a drive piston which in the drive housing separates two drive chambers from one another, said drive chambers being successive in the housing longitudinal direction and each being connected to one of two housing channels, said housing channels passing through the drive housing and each at a housing rear side of the drive housing running out with an individual axial housing coupling opening at a housing rear surface of the drive housing which is orientated in the housing longitudinal direction and being able to be used for the feed and discharge of a drive fluid which generates the linear stroke movement, wherein the drive member is displaceable by way of the linear stroke movement between a rear stroke end position which is approached onto the housing rear side and a front stroke end position which is distanced with respect to this, wherein the rear stroke end position can be set or is set by an external end position setting device of the linear drive which comprises a stroke limitation stop which is arranged on the drive member outside the drive housing and a stroke limitation counter-stop which lies opposite the stroke limitation stop in the housing longitudinal direction and is supported with respect to the drive housing.

A linear drive of this type which is known from EP 0 868 965 A2 has an elongate drive housing and a drive member which is displaceable relative to the drive housing whilst carrying out a linear stroke movement, wherein the drive member comprises a slide unit, with which it is guided in a linearly displaceable manner on an outer side of the drive housing. The drive force for generating a linear stroke movement of the drive member can be produced by a drive fluid, to which in a manner coordinated with one another two drive chambers of the drive housing can be subjected, said chambers being separated from one another in a fluid tight manner by way of the drive piston of a drive unit of the drive member. Each of the two drive chambers communicates with one of two housing channels which pass through the drive housing and which each with an axial housing coupling opening run out at a housing side surface of the drive housing at the outside. Fluid tubes which are suitable for the feed and discharge of the drive fluid can be coupled onto the axial housing coupling openings. The known linear drive is provided with an external end position setting device, by way of which a rear stroke end position of the drive member can be set. It has a stroke limitation stop which is arranged on the drive member and participates in its stroke movement and a stroke limitation counter-stop which lies opposite the stroke limitation stop and which is supported with respect to the drive housing by way of it being fastened to the drive housing. A further external end position setting device, independently of the set rear stroke end position permits the setting of a front stroke end position of the drive member which is opposite with respect to this.

A fluid-actuated linear drive whose drive member for producing a stroke movement can likewise be subjected to a drive fluid in a controlled manner through two housing channels is known from EP 1 574 283 B1, wherein the housing channels each run out with a lateral coupling opening at a module block side surface of the drive housing at the outside. This linear drive is also provided with means which permit the setting of rear and front stroke end positions of the drive member in a variably adjustable manner.

Both known linear drives on account of the integrated travel setting possibilities demand a certain manufacturing effort which is manifested in the manufacturing costs. Given application cases which demand no particular travel setting, these linear drives in principle are functionally over-dimensioned and create costs for the user for measures which he does not actually need.

SUMMARY OF THE INVENTION

It is the object of the invention to provide measures which permit an inexpensive provision of a linear drive independently of whether travel setting measures are necessary or not given its use.

For achieving this object, concerning a fluid-actuated linear drive in combination with the initially mentioned features, one envisages the linear drive comprising a multi-function module which is separate with regard to the drive housing, is designed for the fluid transmission as well as for the stroke limitation of the drive member, comprises a module block and with an axial module block front surface of the module block is built onto the housing rear surface of the drive housing whilst assuming a position of use, wherein two module block channel systems which are suitable for fluid transmission are formed in the module block and each on the one hand with an individual connection opening run out at the module block front surface which faces the housing rear surface of the drive housing, in a manner such that they are each fluidically connected to one of the two axial housing coupling openings, and each on the other hand with at least one individual module block coupling opening run out at an outer surface of the module block which is accessible from outside the linear drive, and wherein the stroke limitation counter-stop of the external end position setting device is a constituent of the multi-function module.

The fluid-actuated linear drive according to the invention as standard on its rear-side housing rear surface has two axial housing coupling openings which are aligned in the housing longitudinal direction and each via an internal housing channel of the drive housing communicate with one of two drive chambers which are separated from one another by the drive piston of a drive unit of the drive member. On operation of the linear drive, a drive fluid is led through the two housing channels, said drive fluid creating a linear stroke movement of the drive member between two stroke end positions due to the fluid impingement of the drive piston. These two stroke end positions are a rear stroke end positions which is approached onto the housing rear side and a front stroke end position which is axial distanced with respect to this. If the drive member is designed such that it projects to the front beyond the drive housing to a greater or lesser extent depending on its travel position, the rear stroke end position represents a retracted stroke end position and the front stroke end position an extended stroke end position. If the particularities which are specific to the application demand no special setting of the rear stroke end position, then the linear drive can be operated in a configuration with a non-installed multi-function module, wherein the axial housing coupling openings on the housing rear side which are then freely accessible can be used directly in order to couple fluid conduits, through which the drive fluid which is necessary for producing the linear stroke movement of the drive member can be fed and discharged. The rear stroke end position in this case is defined by way of example by the internal interaction of the drive piston with the drive housing or can be defined for example in that a constituent of the drive member which lies outside the drive housing and which is preferably provided with a compliant buffer element runs onto the drive housing. Furthermore, the linear drive according to the invention provides the possibility of realising a setting of the rear stroke end position which is independent of the internal interaction between the drive piston and the drive housing, by way of the linear drive being provided in a configuration with the multi-function module being assembled in the position of use. The installed multi-function module has its own stroke limitation counter-stop which can interact with a stroke limitation stop which is arranged on the drive member outside the drive housing, in order to define a desired rear stroke end position. The stroke limitation stop of the drive member and the stroke limitation counter-stop of the multi-function module together define an external end position setting device which sets the rear stroke end position of the drive member. The multi-function module is reliably attached to the housing rear side of the drive housing via the module block, wherein the module block can ensure a high stiffness and accordingly permits very precise settings of the rear stroke end position. Irrespective of the multi-function module which is assembled in the position of use, the internal housing channels can be used for the fluidic control of the drive member as was hitherto the case, since they undergo a continuation in the module block by way of the two module block channel systems which are formed therein. The axial housing coupling openings, although being covered by the module block, however nevertheless via the connection openings of the module block which are flush with them are in fluid connection with the module block channel systems which each run out with at least one individual module block coupling opening at an outer surface of the module block which is accessible from the outside. Hence given the multi-function module built onto the housing rear surface of the drive housing, its module block coupling openings can be used for coupling fluid conduits which feed and discharge the drive fluid which is necessary for the operation of the linear drive.

The linear drive can for example be provided with a multi-function module which is not installed in the position of use, so that the end user has the choice of operating the linear drive either without a multi-function module or after the respective attachment with a multi-function module. This retrofitting possibility however is not necessarily left up the end user of the linear drive, but can already be used from the factory on manufacture of the linear drive by way of the linear drive being delivered with or without a built-on multi-function module according to customer's wishes.

Advantageous further developments of the invention are to be derived from the dependent claims.

Preferably, the axial housing coupling openings of the drive housing which run out at the housing rear surface are each provided with a fastening thread which in a non-assembled position of the multi-function module can be used in order to be able to couple a fluid conduit in a direct or indirect manner. For the direct coupling, a fluid conduit, for example a pipe conduit can be screwed directly into the fastening thread which is designed as an inner thread. For an indirect coupling, a conduit coupling piece, for example a push-in fitting, to which a fluid conduit, for example a fluid tube can be releasably coupled by way of a plug-in connection is attached to the fastening thread.

With regard to the module block coupling openings, a design each with a fastening thread is recommended, so that in the position of use of the multi-function module in a manner which has been explained above with regard to the axial housing coupling openings which are formed with the fastening thread, there is the possibility for the direct or indirect coupling of a fluid conduit.

The two module block channel systems expediently each have a module block coupling opening which is located on a module block rear surface which is opposite to a module block front surface and which on account of its axial alignment is denoted as the axial module block coupling opening for a better differentiation. By way of this, the necessary fluid couplings can be comfortably carried out in the axial direction on the linear drive at the rear side.

It is likewise advantageous if the two module block channel systems each comprise at least one module block coupling opening which is located on a module block side surface of the drive housing which is orientated transversely to the housing longitudinal direction and which for the improved differentiation is therefore denoted as a lateral module block coupling opening. In this manner, fluid conduits can be comfortably coupled from a longitudinal side if the rear side of the fluid-actuated linear drive is difficultly accessible for coupling measures.

A particularly high variability establishes itself if a lateral module block coupling opening of each module block channel system is arranged on two lateral module block side surfaces of the module block which are opposite one another in the housing longitudinal direction. The user can then selectively carry out the necessary fluidic coupling measures at one of two longitudinal sides of the linear drive which are away from one another.

It is particularly advantageous if the two module block channel systems of the multi-function module each run out with an axial module block coupling opening at the module block rear surface as well as with at least one lateral module block coupling opening at at least one module block side surface. In this manner, the user is provided with very variable coupling possibilities. The coupling openings which are not currently used can each be sealingly closed in a simple manner, in particular a releasable manner, by way of a closure element, for example a closure screw.

The multi-function module can be built on the rear side of the drive housing in the position of use in a particularly simple manner if it is axially clamped to the drive housing by way of several fastening screws. The fastening screws each pass through the module block in the housing longitudinal direction and are screwed into a threaded bore of the drive housing, wherein they are supported with their screw head on the module block rear surface. Alternatively, the multi-function mode could also be assembled for example by a latching connection.

It is advantageous if the multi-function module is releasably assembled on the drive housing. This provides the advantageous possibility of disassembling the multi-function module which is situated in the position of use, if necessary into a position of non-use, in particular if no external stroke limitation is necessary and/or the axial construction length or the operating weight of the linear drive is to be reduced.

Expediently, at least one fastening interface which is accessible from outside the linear drive is located on the module block of the multi-function module. It is expediently formed on the module block rear surface. Concerning a preferred design, the fastening interface consists of several fastening bores which are provided with inner threads. The fastening interface can be used by the user of the linear drive, in order to equip the linear drive with additional components or in order to fasten the linear drive to the location of application.

The stroke limitation counter-stop of the external end position setting device is preferably designed separately with respect to the module block and is fastened to the module block in a suitable manner. For example, the module block has a fastening thread, into which the stroke limitation counter-stop is screwed. Alternatively, the module block is provided for example with a clamping device, in which the stroke limitation counter-stop is fixedly clamped in a preferably releasable manner.

Concerning an expedient design, the module block has a cuboid base section whose outer contour expediently corresponds essentially to the outer cross-sectional contour of the drive housing. The two module block channel systems including the various coupling openings of the module block are formed in the cuboid base section. A holding appendix, to which the stroke limitation counter-stop of the external end position setting device is fastened, projects away from this base section transversely to the housing longitudinal direction. In this manner, the module block has a low weight given a high stiffness.

The external end position setting device in principle can be designed such that it only unchangeably sets a very specific rear stroke end position of the drive member. Herein, the rear stroke end position is specified by the specific design of the assembled multi-function module. However, what is more advantageous with respect to this, because it can be used in a significantly more universal manner, is an external end position setting device which is designed for a variable setting of the rear stroke end position of the drive member. The user therefore has the possibility of specifically setting the rear stroke end position in accordance with the application case.

In the context of a variable setting possibility, the stroke limitation counter-stop is expediently attached to the module block in an infinitely adjustable manner in the housing longitudinal direction. The infinite adjustment can be realised for example by way of the stroke limitation counter-stop being screwed into a fastening screw and being able to be axially adjusted by way of rotating into the fastening thread.

A damping element which ensures a damping of the impact when the drive member approaches onto the set stroke end position can be assigned to the stroke limitation stop and/or to the stroke limitation counter-stop. In the simplest case, the damping element is a rubber-elastic buffer element. A more effective damping can be realised given a design as a pneumatic or hydraulic shock absorber. The damping element can be designed separately to the assigned stop or counter-stop, but however is preferably integrated in the respective stop or counter-stop.

The external end position setting device permits the setting of a rear stroke end position independently of the interaction of the drive piston with the drive housing. Thus rear stroke end positions in which the drive piston has not yet been brought to abut on the drive housing can be set. With some applications, it furthermore makes sense for the linear drive to comprise a further external end position setting device which likewise independently of the interaction between the drive position and the drive housing provides the possibility of setting a front or extended stroke end position of the drive member. This optional further external end position setting device expediently has a further stroke limitation stop which is arranged on the drive member outside the drive housing, and a further stroke limitation counter-stop which lies opposite the further stroke limitation stop in the housing longitudinal direction and is arranged on the drive housing at an axial distance to the multi-function module.

The further external end position setting device in principle can be designed such that it only unchangeably defines a certain front stroke end position. With regard to this, however a design by way of which a variable setting of the front stroke end position of the drive member is possible is more favourable.

The further stroke limitation stop is expediently located on a rear-side terminating element of the drive member which faces the housing rear side of the drive housing and which simultaneously forms the stroke limitation stop of the external end position setting device which serves for setting the rear stroke end position. If the linear drive is to be operated without travel setting possibilities, then the terminating element of the drive member can be omitted. It is preferably attached in a releasable manner, so that it can be disassembled if required.

In particular, for accommodating high transverse forces, it is advantageous if the drive member has slide unit which is linearly displaceably mounted on the drive housing at the outside by way of a linear guide device and which comprises the stroke limitation stop of the external end position setting device. Expediently, the slide unit comprises at least one fastening interface, to which an external component, for example a machine component, which is to be moved by the linear stroke movement, can be fastened.

BRIEF DESCRIPTION OF THE DRAWINGS

The invention is hereinafter explained in more detail by way of the accompanying drawing. In these are shown in.

DETAILED DESCRIPTION

Figure 1:
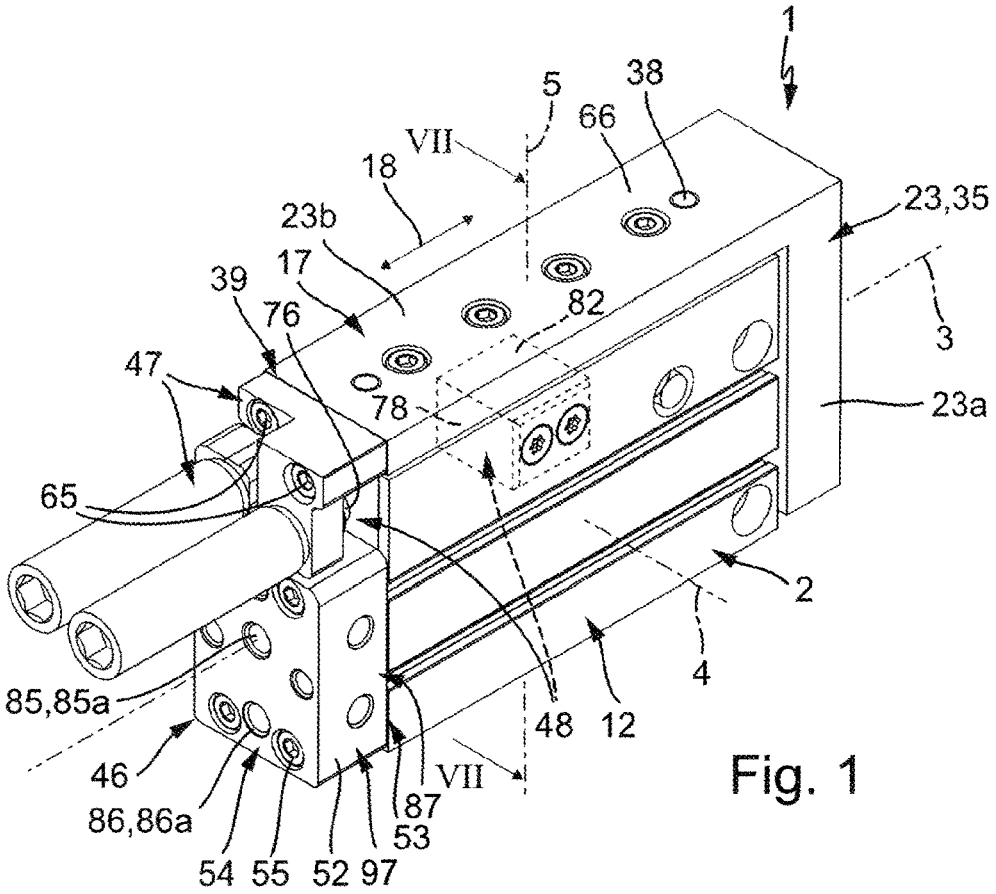
FIG. 1 an isometric rear view of a preferred construction form of the fluid actuated linear drive according to the invention, with a multi-function module assembled in the position of use and with the drive member positioned in the rear stroke end position, FIG. 2 a further isometric rear view of the linear drive from a viewing angle which is different compared to FIG. 1, wherein internal fluid channels are indicated in a dashed manner, FIG. 3 the linear drive of FIGS. 1 and 2 in an isometric rear view comparable to FIG. 1, but given a drive member which assumes an extended stroke end position.
Figure 2:
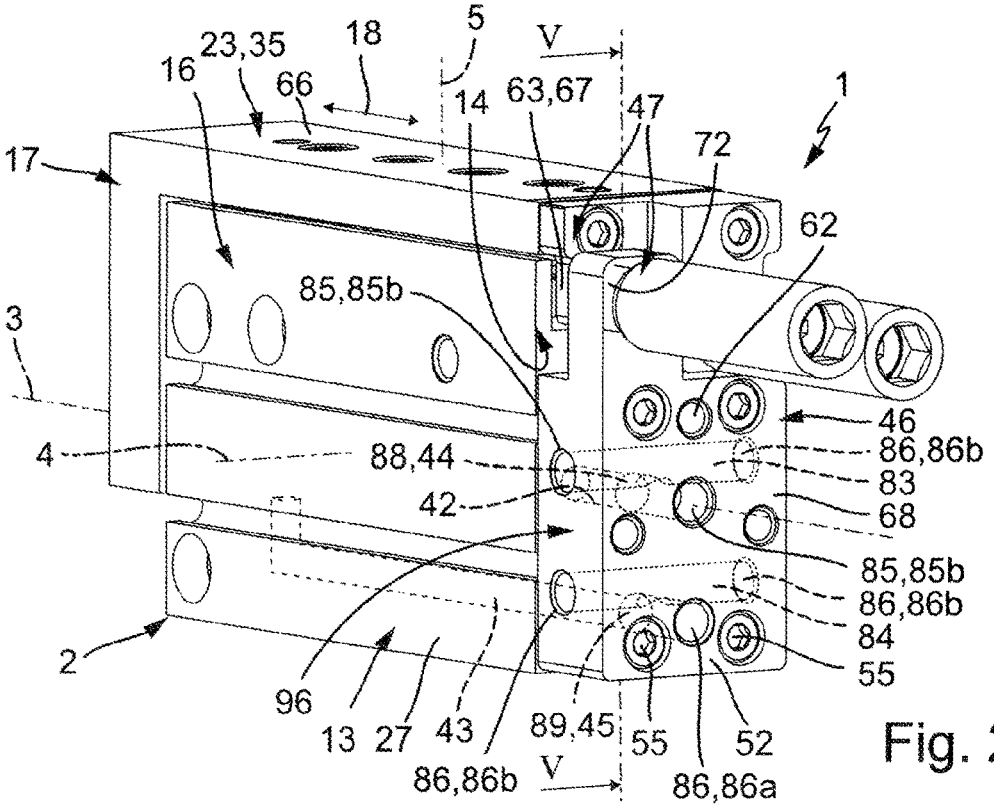
Figure 3:
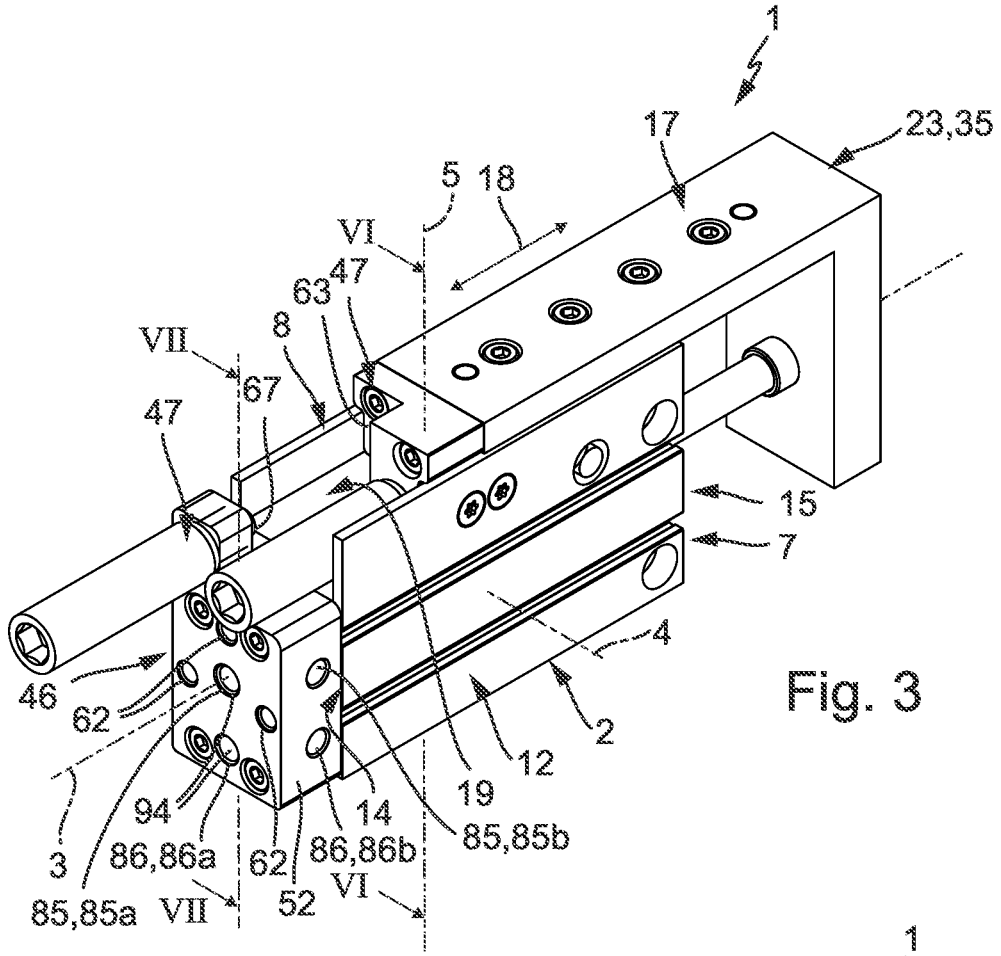

The fluid-actuated linear drive which is denoted in its entirety with the reference numeral 1 is preferably designed for actuation by way of pressurised air as a drive fluid, but is also suitable for actuation by way of other gaseous or also liquid drive fluids.

The linear drive 1 comprises a drive housing 2 which preferably has a longitudinal shape. The drive housing 2 has a longitudinal axis 3 which defines a housing longitudinal direction 3, a transverse axis 4 which is at right angles thereto and which defines a housing transverse direction 4 as well as a height axis 5 which at right angles to the longitudinal axis 3 and the transverse axis 4 and which defines a hosing height direction 5. The drive housing 2 is preferably designed in a plate-like or block-like manner.

The drive housing 2 has a housing rear side 6 which is orientated in the housing longitudinal direction 3 and a housing front side 7 which is axially opposite with respect to this. Furthermore, the drive housing 2 has a housing upper side 8 which is orientated in the housing height direction 5 and a housing lower side 9 which is opposite with respect to this. Furthermore, the drive housing 2 has two first and second lateral longitudinal sides 12, 13 which are orientated in the housing transverse direction 4 and are opposite one another.

The drive housing 2 has a housing rear surface 14 at the housing rear side 6. The housing rear surface 14 faces axially in the housing longitudinal direction 3, wherein the housing longitudinal direction 3 preferably represents a direction of a normal to the housing rear surface 14. At the housing front side 7, the drive housing 2 has a housing front surface 15 which is orientated opposite to the housing rear surface 14.

The drive housing 2 further has a housing side surface 16 which extends all around the drive housing 2 between the housing rear surface 14 and the housing front surface 15.

Expediently, a trough-like deepening 19 which is open at the longitudinal side and which furthermore is axially open to the housing rear surface 14 as well as to the housing front surface 15 is formed in the drive housing 2 in the region of the housing upper side 8.

The linear drive 1 further comprises a drive member 17 which can be linearly displaced to and fro in the housing longitudinal direction 3 with respect to the drive housing 2. The drive member 17 is driveable by the drive fluid into a linear stroke movement 18 in the housing longitudinal direction 3, said stroke movement being indicated by the double arrow. The stroke movement 18 in particular can be designed as a to and froing linear movement.

The drive member 17 has a drive unit 21 which extends partly within and partly outside the drive housing and which by way of example projects out of the drive housing 2 at the housing front surface 15. The drive unit 21 has a force output section 22 which is always arranged outside the drive housing 22.

The drive unit 21 extends in a housing chamber 24 which is formed in the inside of the drive housing, is preferably contoured in a cylindrical manner and which extends in the housing longitudinal direction 3. The housing chamber 24 is closed by a rear closure cover 25 in the region of the housing rear side 6 and is closed in a fluid-tight manner by a front closure cover 26 in the region of the housing front side 7.

By way of example, the drive housing 2 has a rigid housing base body 27 which defines the outer contour of the drive housing and in which the optional trough-like deepening 19 is also formed. A housing bore 30 which is manufactured in an arbitrary way and manner, and into which the two closure covers 25, 26 are inserted for axially delimiting the housing chamber 24, passes through the housing base body 27.

Each closure cover 25, 26 is fixed in an axially immovable manner with respect to the housing base body 27. This can be effected for example with the aid of securing elements, a screw connection or a press-in connection. A sealing, by way of which the housing chamber 24 is sealed to the surroundings of the linear drive 1 is present between each closure cover 25, 26 and the housing base body 27.

The drive unit 21 has a drive piston 8 which is arranged in the housing chamber 24 and which bears on the wall of the housing chamber 24 in a slidingly displaceable manner amid sealing. The drive piston 28 subdivides the housing chamber 24 into a rear drive chamber 32 which faces the housing rear side 14 and a front drive chamber 33 which faces the housing front side 7. The rear drive chamber 32 at the rear side is closed by the rear closure cover 25, whereas the front drive chamber 33 is closed at its front side by the front closure cover 26.

By way of example, the drive unit 21 has a piston rod 29 which is attached to the drive piston 28 and which extends through the front drive chamber 33 and—in a sealed and slidingly movable manner—through the front closure cover 26 which connects thereto, wherein the end section of this piston rod which lies outside the drive housing 2 forms the force output section 22 which is discussed further above.

The drive member 17 has a force output unit 23 which is arranged outside the drive housing and is coupled in movement to the drive unit 21. The two units 21, 23 can always only be moved together as one unit in the housing longitudinal direction 3.

The linear stroke movement 18 of the drive member 17 can be created by the drive fluid by way of a fluid impingement of the two drive chambers 32, 33 which is coordinated with one another. The stroke movement 18 is manifested either in an extension stroke movement 18*a* which is orientated to the front away from the housing rear side 18*a*, or in a retraction stroke movement 18*b* which is opposite with regard to this.

Preferably, at least one fastening interface 38 is formed on the force output unit 23, to which fastening interface an external component, for example a machine part, which is to be moved by the linear drive 1 can be fastened.

The force output unit 23 of the drive member 17 preferably has a first part-section 23*a* which is attached to the force output section 22 of the piston rod 29, and a second part-section 23*b* which is connected thereto and which extends along the drive housing 2 in the housing longitudinal direction 3 in the region of the housing upper side 8. The two part-sections 23*a*, 23*b* are preferably arranged in an L-shaped manner.

The force output unit 23 is preferably conceived as a slide unit 35 which on the drive housing at the outside is mounted on the drive housing 2 in a linear displaceable manner by way of a linear guide device 36 which extends in the housing longitudinal direction 3 in the region of the housing upper side 8. The linear guide device 36 is preferably arranged in the trough-like deepening. The second part-section 23*b* of the force output unit 23 designed for example as a slide unit 35 extends longitudinally along the open side of the trough-like deepening 19 and covers this to the top depending on the assumed travel position.

The force output unit 23 has a rear end section 39 which lies longitudinally next to the drive housing 2 and which faces the housing rear side 6. This rear end section 39 by way of example is located on the end region of the second part-section 23*b* of the force output unit 23, said end region being opposite to the first part-section 23*a*.

Each of the two drive chambers 32, 33 is in fluid connection with one of two housing channels 42, 43 which pass through the drive housing 2. Hereinafter, for a better differentiation, the housing channel 42 which is connected to the rear drive chamber 32 is also denoted as a rear housing channel 42 and the housing channel 43 which is connected to the front drive chamber 33 is also denoted as the front housing channel 43.

Each of the two housing channels 42, 43 runs out with an individual axial housing coupling opening 44, 45 which is opposite to the drive chamber 32, 33 which is connected onto it, at the housing rear surface of the drive housing 2. These axial housing coupling openings 44, 45 can be used in order to subject the respectively assigned drive chamber 32, 33 to the drive fluid in a controlled manner so that the linear stroke movement 18 of the drive member 17 is produced.

By way of example, the rear housing channel 42 extends axially through the rear closure cover 25, wherein the assigned axial housing coupling opening 44 is formed directly in the rear closure cover 25.

The front housing channel 43 extends partly in the wall section of the drive housing which peripherally delimits the housing chamber 24, and partly in the front closure cover 26. Preferably, each housing channel 42, 43 on the assigned closure cover 25, 26 runs into the drive chamber 32, 33 which is delimited by the closure cover 25, 26. The axial housing coupling opening 45 which belongs to the front housing channel 43 by way of example is formed in the housing base body 27.

The two axial housing coupling openings 44, 45 bear on the housing rear side 6 expediently in a common plane which is at right angles to the longitudinal axis 3. Furthermore, the two housing coupling openings 44, 45 are preferably arranged lying above one another in the housing height direction 5.

The linear drive 1 as a further component comprises a multi-function module 46 which is separate with respect to the drive housing 2 and also with respect to the drive member 17. The linear drive 1 can be operated selectively either in a configuration, in which the multi-function module 46 is attached to the drive housing 2 in the position of use, or in a configuration, in which the multi-function module is removed from the drive housing 2 whilst assuming a position of non-use.

The multi-function module 46 in the position of use in which it is built onto the drive housing 2, serves for the fluid transmission of the drive fluid as well as for the stroke limitation of the drive member 17 given its linear stroke movement 18. The stroke limitation is preferably only effective given the retraction stroke movement 18*b*, specifically in order to set a rear stroke end position of the drive member 17 which is approached onto the housing rear side 6 and which is evident in the drawing in FIGS. 1, 2, 5 and 7. Inasmuch as this is concerned, the multi-function module 46 represents a constituent of an external end position setting device 47 of the linear drive 1, by way of which end position setting device the rear stroke end position of the drive member 17 can be set via a stop function.

The external end position setting device 47 is hereinafter also denoted as a first external end position setting device 47, in order to differentiate it from a further external end position setting device 48 which is denoted as a second external end position setting device 48 and with which the linear drive 1 is preferably likewise provided and which permits the setting of a front stroke end position of the drive member 17.

Whereas the rear stroke end position marks the end of the retraction stroke movement 18*b*, the front stroke end position marks the end of the extension stroke movement 18*a*.

Without the external or first end position setting device 47, the rear stroke end position in the case of the illustrated embodiment example would be given by way of the force output unit 23 running onto the drive housing 2 at the housing front side 7. For damping the impact which herein takes place, the force output unit 23 is expediently designed with an elastic buffer element 23. Such a buffer element 49 by way of example is arranged on the inner side of the first part-section 23*a* of the force output unit 23, said inner side facing the drive housing 12. By way of this measure, one can avoid the drive piston hitting the rear closure cover 25 even in the case of a non-existent external or first end position setting device 47. However, for setting the rear stroke end position without the external end position setting device 47, one can indeed envisage the drive piston 28 being able to hit the rear closure cover 25.

Figure 4:
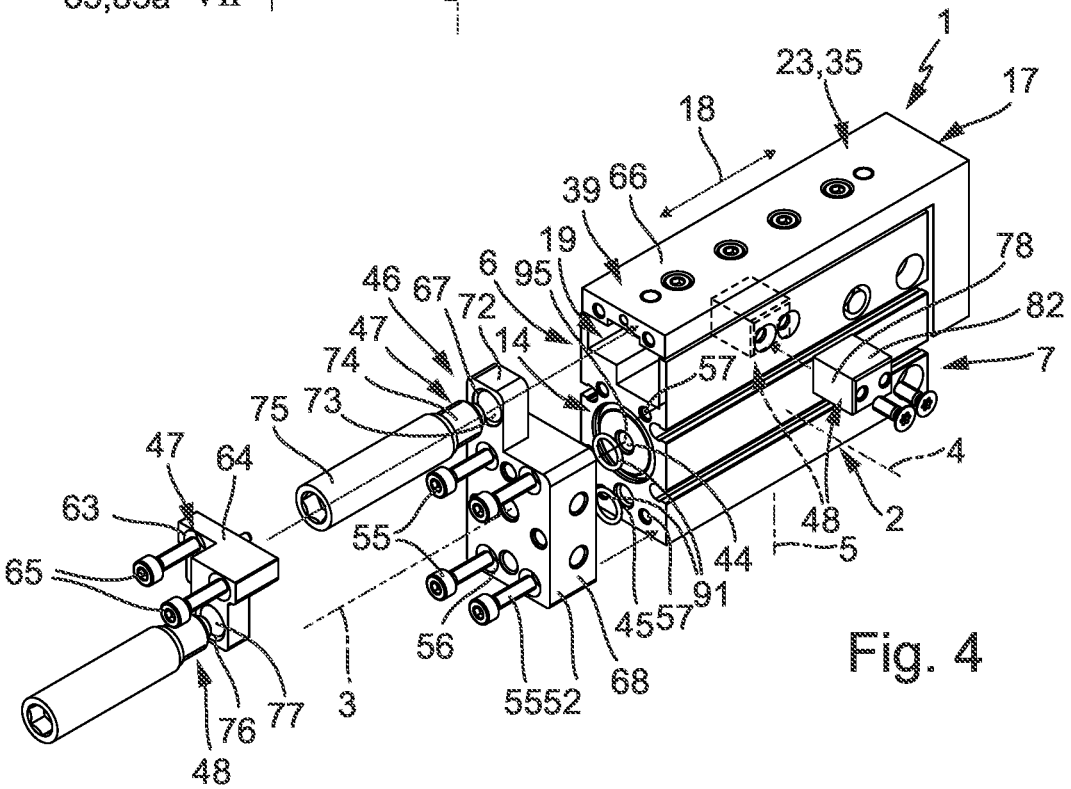
FIG. 4 an isometric exploded representation of the linear drive of FIGS. 1 to 3, wherein a dissembled position of non-use of the multi-function module is evident, so that axial housing coupling openings which run out at the rear surface of the drive housing are directly assessable for the coupling of fluid conduits, FIG. 5 a longitudinal section of the linear drive according to section plane V-V of FIG. 2, given a drive member located in the rear stroke end position, FIG. 6 a further longitudinal section of the linear drive according to section plane VI-VI of FIG. 3 in a front stroke end position of the drive member, and FIG. 7 a further longitudinal section of the linear drive according to section plane VII-VII of FIGS. 1 and 3 given a drive member situated in the rear stroke end position, wherein the housing channels and channel sections of the two module block channel systems are easy to recognize.
Figure 5:
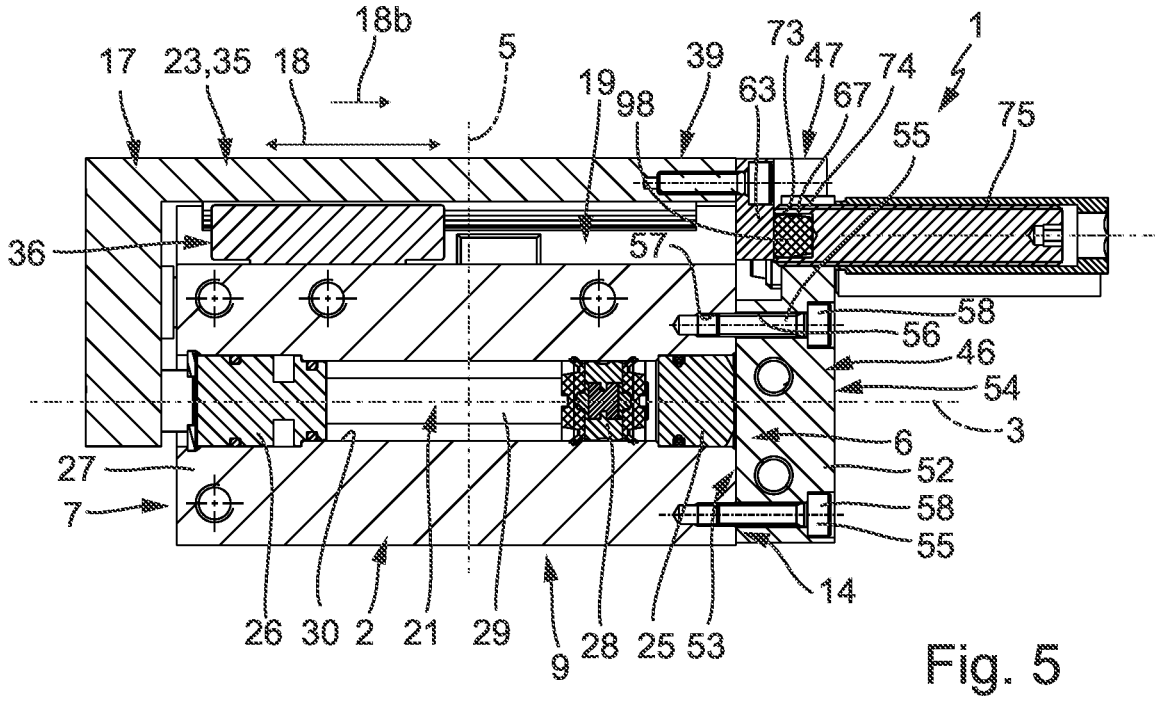
Figure 6:
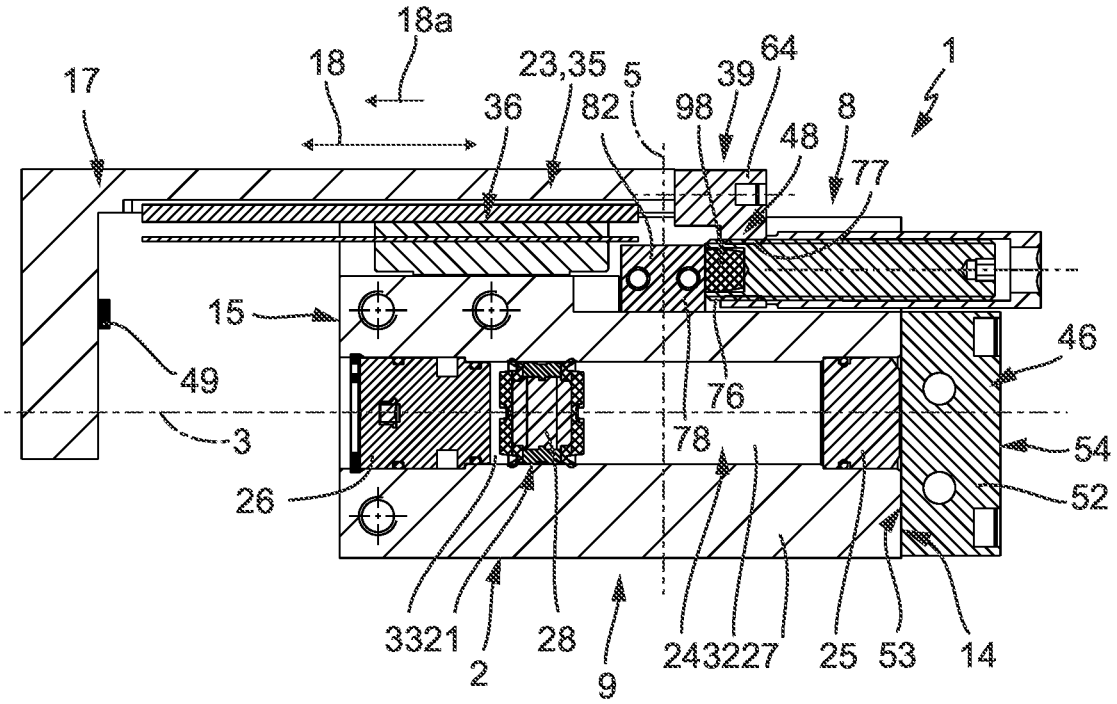
Figure 7:
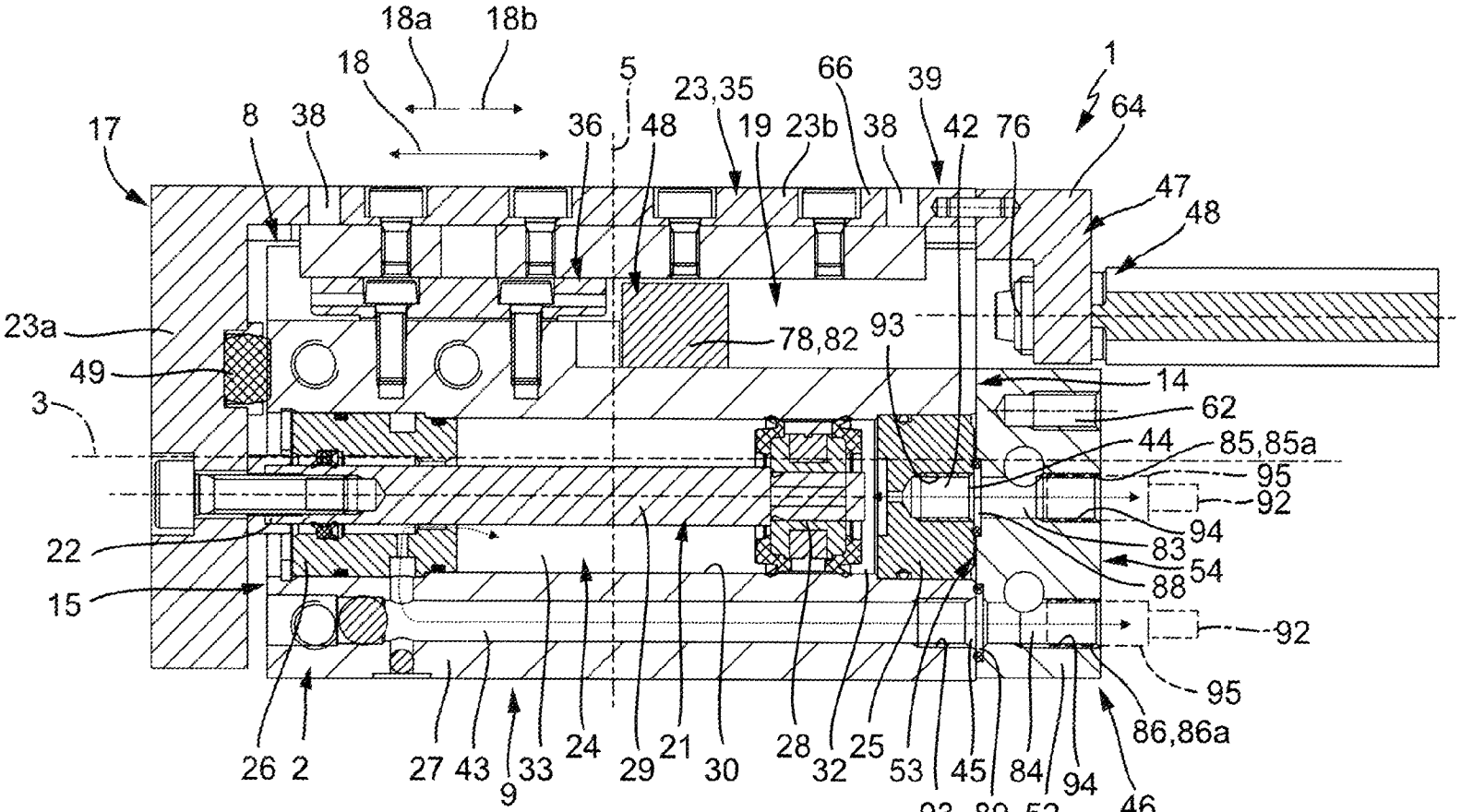

The linear drive 1 can be used in the aforementioned operating manner if the multi-function module 46 is not assembled and accordingly assumes a position of non-use in which it is removed from the drive housing 2 and which is illustrated in FIG. 4.

Without the further or second external end position setting device 48, the front stroke end position in particular would be set by way of the drive piston 28 hitting the front closure cover 26 at the inside.

The two first and second external end position setting devices 47, 48 in particular each permit an adjustable end position setting without the participation of the drive piston 28 of the drive member 17 which is therefore relieved with regard to loading.

In the configuration with the multi-function module 46 situated in the position of use, the linear drive 1 has the (first) external end position setting device 47, by way of which a rear stroke end position of the drive member in which the drive piston 28 is distanced to the rear closure cover 25 can be mechanically set.

The multi-function module 46 has a module block 52 which comprises a module block front surface 53 and a module block rear surface 54 which is opposite and away with respect to this. In the position of use, the multi-function module 46 with the module block front surface 53 of the module block 52 is built onto the housing rear surface 14 of the drive housing 2.

In the state in which it is built onto the housing rear surface 14, the module block 52 with its module block front surface 53 is supported on the facing housing rear surface 14 of the drive housing 2 in the housing longitudinal direction 3. By way of a suitable fastening measure, the module block 52 is fixed to the drive housing 2, preferably in a releasable manner, in the position of use.

The fastening measure by way of example is realised amid the use of several fastening screws 55. Several through-holes 56 which in the position of use of the multi-function module 46 are each flush with a blind-hole-like threaded bore 57 which runs out at the housing rear surface 14 pass through the module block 52 in the housing longitudinal direction 3, wherein a fastening screw 55 which is screwed into the assigned threaded bore 57 engages through each through-hole 56. With its screw head 58, the fastening screw 55 is supported on the module block rear surface 54, so that the module block 52 is clamped axially to the drive housing 2. The screw heads 58 are preferably received in the module block 52 in a sunk manner.

By way of example, the through-holes 56, threaded bores 57 and the fastening screws 55 are present in fourfold and considered in the housing longitudinal direction 3 in particular are placed in the corner regions of an imaginary rectangle.

At least one fastening interface 62 which is formed on the module block 52 and which preferably consists of one or more fastening holes which are provided with an inner thread can be used to attach external additional components to the linear drive or to fasten the linear drive 1 to a holding structure.

The at least one fastening interface 62 is advantageous but nevertheless is optional. Inasmuch as is present, in particular it is located on the module block rear surface 54.

The first external end position setting device 47 has a stroke limitation stop 63 which is arranged on the drive member 17 outside the drive housing 2 and which is hereinafter also denoted as a first stroke limitation stop for an improved differentiation. This first stroke limitation stop 63 is expediently located on the rear end section 39 of the force output section 22 of the drive member 17. The first stroke limitation stop 63 is preferably formed by a rigid, rear-side terminating element 64 of the drive member 17 which with the help of fastening screws 65 is built on a plate-like base body 66 of the force output unit 23 which extends along the housing upper side 8. Inasmuch as no external travel setting measure is desired, the terminating element 64 can be omitted.

The first stroke limitation stop 63 can be formed by an arbitrary other constituent of the drive member 17 without further ado. However, as mentioned it is preferably situated on the rear end section 39.

The first stroke limitation stop 63 participates in the linear stroke movement 18. A stroke limitation counter-stop of the first external end position setting device 47 which is designed as a constituent of the multi-function module 46 and which is denoted as a first stroke limitation counter-stop 67 lies in the movement path of this first stroke limitation stop 63.

The first stroke limitation counter-stop 67 is expediently designed as a component which is separate with regard to the module block 52, and fastened to the module block 52, in particular in a releasable manner, by way of suitable measures. The stroke limitation counter-stop is attached to the module block 52 in an infinitely adjustable manner in the housing longitudinal direction, in a manner such that it is suitable for the alternative setting of different rear stroke end positions of the drive member 17.

By way of example, the module block 52 has a cuboid base section 68, through which through-holes 56 pass and from which a holding appendix 72 projects transversely to the housing longitudinal direction 3, on which holding appendix the first stroke limitation counter-stop 67 is fastened such that it lies in the linear movement path of the first stroke limitation stop 63.

A particularly simple variable setting of the rear stroke end position of the drive member 17 is possible if in accordance with the embodiment example, a threaded bore 73, into which the first stroke limitation counter-stop 67 is screwed with an outer threaded section 74 passes through the holding appendix 72 in the housing longitudinal direction 3. The first stroke limitation counter-stop 67 can be very simply adjusted relative to the module block 52 in the housing longitudinal direction 3 by way of it being rotated about its longitudinal axis and being axially displaced in the threaded bore 73 in the course of a screwing procedure. The travel setting position of the first stroke limitation counter-stop 67 which is set by the screwing procedure can be releasably fixed by a securing element 75 which in particular acts in the manner of a lock nut.

The optional second external end position setting device 48 preferably has an individual stroke limitation stop 76 which is arranged on the drive member 17 outside the drive housing 2 and which for an improved differentiation is denoted as a second stroke limitation stop 76 and participates in the linear stroke movement 18 of the drive member 17. It is expediently seated on the rear end section 39, wherein it is preferably attached to the optional terminating element 64.

The construction of the second stroke limitation stop 76 by way of example corresponds to the construction of the first stroke limitation counter-stop 67, so that the explanations related to this are referred to. The second stroke limitation stop 76 preferably permits a variable setting of the front stroke end position of the drive member 17, by way of it being screwed into a threaded bore 77 of the terminating element 64 and being adjusted in the housing longitudinal direction 3 by way of a simple rotation.

The second stroke limitation stop 76 cooperates with a further stroke limitation counter-stop 78 which belongs to the second external end position setting device 48 and which is denoted as a second stroke limitation counter-stop 78 and which is fastened to the drive housing 2 at an axial distance to the multi-function module 46.

By way of example, the second stroke limitation counter-stop 78 is formed by a stop block 82 which is arranged in the trough-like deepening 19 in the travel path of the second stroke limitation stop 76. The stop block 82 by way of example is fastened to the housing base body 27 of the drive housing 2 by way of fastening screws 83.

Even if the multi-function module 46 is assembled in the position of use, the two housing channels 42, 43 can be used for the fluidic activation of the drive unit 21 as was hitherto the case. The reason for this is the fact that two first and second module block channel systems 83, 84 which are suitable for fluid transmission are formed in the module block 52 and in the position of use of the multi-function module 46 are each fluid-connected to one of the two housing channels 42, 43 and thus both lengthen the two housing channels 42, 43 through the module block 52. Each module block channel system 83, 84 has at least one individual module block coupling opening 85, 86, wherein each module block coupling opening 85 of the first module block channel system 83 is also to be denoted as a first module block coupling opening 85 and each module block coupling opening 86 of the second module block channels system 84 as a second module block coupling opening 86.

Each module block coupling opening 85, 86 runs out in a region which is not covered by the drive housing 2 and therefore at an outer surface 87 of the module block 52 is easily accessible from outside the linear drive 1.

For the fluid connection to the housing channels 42, 43, the two module block channel systems 83, 84 each run out with an individual connection opening 88, 89 at the module block front surface 53 which faces the housing rear side 6. For an improved differentiation, the connection opening 88 of the first module block channel system 83 is also denoted as the first connection opening 88 and the connection opening 89 of the second module block channel system 84 also as a second connection opening 89.

The two connection openings 88, 89 are placed in a manner such that in the position of use of the multi-function module 46, the first connection opening 88 is flush with the axial housing coupling opening 44 of the rear housing channel 42 and the second connection opening 89 with the axial housing coupling opening 45 of the front housing channel 43. At least one sealing device 91 is arranged in the joining region between the drive housing 2 and the module block 52, said sealing device framing the connection openings 88, 89 and the housing coupling openings 44, 45 which are flush with one another and ensuring a leakage-free fluid passage.

In the position of use of the multi-function module 46, the module block coupling openings 85, 86 can therefore be used instead of the axial housing coupling openings 44, 45 in order to feed and discharge the drive fluid which is necessary for actuating the linear drive 1.

The fluid conduits 92 which serve for the feed and discharge of the drive fluid, in the position of use of the multi-function module 46 can be connected onto the module block coupling openings 85, 86 of the module block 52 and in the position of non-use of the multi-function module 46 can be connected onto the axial housing coupling openings 44, 45 of the drive housing 2 which are then accessible.

The axial housing coupling openings 44, 45 are expediently provided with fastening threads 93 which are designed as an inner thread, for the coupling of the fluid conduits 92. Expediently, all module block coupling openings 85, 86 have a corresponding design with fastening threads 94 which are designed as an inner thread. The fastening threads 93, 94 can be used for example, in order to screw in fluid conduits in a direct manner or in order to screw in a conduit coupling piece 95 in accordance with the illustration in FIG. 7, said conduit coupling piece being suitable for coupling a fluid conduit 92 by way of a plug-in connection or another manner.

It is advantageous if the first and second module block coupling openings 85, 86 are each present in multiple and are located on different surface sections of the outer surface 87 of the module block 52. By way of example, the first module block channel system 83 comprises three first module block coupling openings 85 and the second module block channel system 84 comprises three second module block coupling openings 86.

A first and second module block coupling opening 85, 86 is designed as an axial module block coupling opening 85*a*, 86*a* which is located on the module block rear surface 54. Furthermore, two first module block coupling openings 85 and two second module block coupling openings 86 are each designed as lateral module block coupling openings 85*b*, 86*b* which are located on two lateral module block side surfaces 96, 976 which are opposite to one another and which are each orientated transversely to the housing longitudinal direction 3 and specifically in a manner such that their normal direction coincides with the housing transverse direction 4.

It is to be understood that of the several first and second module block coupling openings 85, 86, only one module block coupling opening 85, and 86 is used at the same time. The respectively non-used module block coupling openings 85, 86 are then sealingly closed by way of closure elements of the linear drive 1 which are not illustrated further. Concerning the closure elements, these for example are closure plugs which can be screwed in.

The assigned module block channel system 83, 84 branches within the module block 52 for realising several module block coupling openings 85, 86.

It is to be understood that each module block channel system 83, 84 can also be equipped with a number other than the described number of module block coupling openings 85, 86. For example, each module block channel system 83, 84 can exclusively have an axial module block coupling opening 85*a*, 86*a* or also exclusively a lateral module block coupling opening 85*b*, 86*b*.

The two module block channel systems 83, 84 expediently extend exclusively in the base section 68 of the module block 52.

The drive member 17 is stopped in the rear stroke end position by way of it hitting, with its first stroke limitation stop 63, the stroke limitation counter-stop 67 which is stationary with respect to the drive housing 2. The same applies with regard to the setting of the front stroke end position which establishes itself given the hitting of the second stroke limitation stop 76 upon the second stroke limitation counter-stop 78 which is stationary with respect to the drive housing 2. In order for the intensity of the impact to be as low as possible on reaching the respective stroke end position, expediently each external end position setting device 487, 48 is provided with a damping element 98 which ensures an impact damping and with regard to which by way of example it is a rubber-elastic buffer element. Alternatively, the damping element 98 can also be a pneumatic or hydraulic shock absorber.

What is claimed is:

1. A fluid-actuated linear drive comprising a drive housing and a drive member which by fluid force can be driven relative to the drive housing into a linear stroke movement in a housing longitudinal direction, wherein the drive member comprises a drive piston, which in the drive housing divides off a front drive chamber from a rear drive chamber, said front drive chamber and said rear drive chamber being successive in the housing longitudinal direction and each being connected to one of two housing channels, said housing channels passing through the drive housing and each housing channel having an individual axial housing coupling opening disposed at a housing rear side of the drive housing at a housing rear surface of the drive housing which is orientated in the housing longitudinal direction and being able to be used for the feed and discharge of a drive fluid which generates the linear stroke movement, wherein the drive member is displaceable by the linear stroke movement between a rear stroke end position at the housing rear side and a front stroke end position which is distanced with respect to the rear stroke end position, wherein the rear stroke end position can be set or is set by an external end position setting device of the linear drive which comprises a stroke limitation stop which is arranged on the drive member outside the drive housing and a stroke limitation counter-stop which lies opposite the stroke limitation stop in the housing longitudinal direction and is supported with respect to the drive housing, wherein the linear drive comprises a multi-function module which is separate with regard to the drive housing, is designed for the fluid transmission as well as for the stroke limitation of the drive member, comprises a module block and with an axial module block front surface of the module block is connected to the housing rear surface of the drive housing whilst assuming a position of use, wherein two module block channel systems which are suitable for fluid transmission are formed in the module block, wherein each module block channel system comprises an individual connection opening and an individual module block coupling opening, the individual connection opening being disposed at the module block front surface which faces the housing rear surface of the drive housing, in a manner such that they are each fluidically connected to one of the two axial housing coupling openings, and wherein each individual module block coupling opening is disposed at an outer surface of the module block which is accessible from outside the linear drive, and wherein the stroke limitation counter-stop of the external end position setting device is a constituent of the multi-function module, and wherein the front drive chamber is closed by a front closure cover in a region of a housing front side and the rear drive chamber is closed by a rear closure cover in a region of the housing rear side.

2. The linear drive according to claim 1, wherein the two axial housing coupling openings are each provided with a fastening thread which in a position of non-use of the multi-function module in which the multi-function module is removed from the position of use can be used for the direct or indirect coupling of a fluid conduit which serves for the feed and discharge of a drive fluid.

3. The linear drive according to claim 1, wherein the module block coupling openings of the two module block channel systems are each provided with a fastening thread which in the position of use of the multi-function module can be used for the direct or indirect coupling of a fluid conduit which serves for the feed and discharge of a drive fluid.

4. The linear drive according to claim 1, wherein the two module block channel systems each comprise a module block coupling opening, defining an axial module block coupling opening which is arranged on a module block rear surface which is opposite to the module block front surface.

5. The linear drive according to claim 1, wherein the two module block channel systems each comprise at least one module block coupling opening defining a lateral module block coupling opening which is disposed at a module block side surface of the module block which is orientated transversely to the housing longitudinal direction.

6. The linear drive according to claim 5, wherein the module block has two lateral module block side surfaces which are opposite to one another transversely to the housing longitudinal direction, wherein a lateral module block coupling opening of each module block channel system is arranged on each of these two lateral module block side surfaces.

7. The linear drive according to claim 1, wherein the multi-function module is clamped to the drive housing in the housing longitudinal direction by several fastening screws, wherein the fastening screws each pass through the module block and are screwed into a threaded bore of the drive housing.

8. The linear drive according to claim 1, wherein at least one fastening interface which is accessible from outside the linear drive is formed on the module block of the multi-function module.

9. The linear drive according to claim 8, wherein the at least one fastening interface is formed on a module block rear surface of the multifunction module which is opposite to the module block front surface.

10. The linear drive according to claim 1, wherein the stroke limitation counter-stop of the external end position setting device is designed separately with respect to the module block and is fastened to the module block.

11. The linear drive according to claim 10, wherein the module block has a base section, in which the two module block channel systems are formed and from which a holding appendix projects transversely to the housing longitudinal direction, to which holding appendix the stroke limitation counter-stop of the external end position setting device is fastened.

12. The linear drive according to claim 1, wherein the external end position setting device is designed for a variable setting of the rear stroke end position of the drive member.

13. The linear drive according to claim 12, wherein the stroke limitation counter-stop of the external end position setting device is formed separately with respect to the module block and is fastened to the module block, wherein the stroke limitation counter-stop of the external end position setting device is attached to the module block in an infinitely adjustable manner in the housing longitudinal direction, for the alternative setting of different rear stroke end positions of the drive member.

14. The linear drive according to claim 1, wherein, for the setting of the front stroke end position of the drive member, the linear drive comprises a further external end position setting device which has a further stroke limitation stop which is arranged on the drive member outside the drive housing, and a further stroke limitation counter-stop which lies opposite the further stroke limitation stop in the housing longitudinal direction and is arranged on the drive housing at an axial distance to the multi-function module.

15. The linear drive according to claim 14, wherein the further external end position setting device is designed for a variable setting of the front stroke end position of the drive member.

16. The linear drive according to claim 14, wherein the further stroke limitation stop of the further external end position setting device is arranged on a rear-side terminating element of the drive member which faces the housing rear side of the drive housing and which simultaneously forms the stroke limitation stop of the external end position setting device which serves for setting the rear stroke end position.

17. The linear drive according to claim 1, wherein the drive member comprises a slide unit which is linearly displaceably mounted outside on the drive housing by a linear guide device of the linear drive and which comprises the stroke limitation stop of the external end position setting device.

* * * * *